US012781430B2

(12) United States Patent
Kuroda et al.

(10) Patent No.: US 12,781,430 B2
(45) Date of Patent: Nov. 3, 2026

(54) SKIN MATERIAL

(71) Applicants: NISSAN MOTOR CO., LTD., Yokohama (JP); SEIREN CO., LTD., Fukui (JP)

(72) Inventors: Motohiko Kuroda, Kanagawa (JP); Moe Yamazaki, Kanagawa (JP); Kyosuke Takeshita, Fukui (JP)

(73) Assignees: NISSAN MOTOR CO., LTD., Yokohama (JP); SEIREN CO., LTD., Fukui (JP)

( * ) Notice: Subject to any disclaimer, the term of this patent is extended or adjusted under 35 U.S.C. 154(b) by 229 days.

(21) Appl. No.: 18/717,621

(22) PCT Filed: Dec. 7, 2022

(86) PCT No.: PCT/IB2022/000707
§ 371 (c)(1),
(2) Date: Jun. 7, 2024

(87) PCT Pub. No.: WO2023/105285
PCT Pub. Date: Jun. 15, 2023

(65) Prior Publication Data

US 2025/0050627 A1 Feb. 13, 2025

(30) Foreign Application Priority Data

Dec. 8, 2021 (JP) ..... 2021-199042

(51) Int. Cl.
*D06N 3/00* (2006.01)
*D06N 3/14* (2006.01)

(52) U.S. Cl.
CPC ..... *D06N 3/0068* (2013.01); *D06N 3/0088* (2013.01); *D06N 3/145* (2013.01); *D06N 3/146* (2013.01); *D06N 2211/28* (2013.01)

(58) Field of Classification Search
CPC .. B32B 27/20; B32B 27/40; D06N 2209/106; D06N 2211/28; D06N 3/0068; D06N 3/0088; D06N 3/14; D06N 3/145; D06N 3/146
See application file for complete search history.

(56) References Cited

U.S. PATENT DOCUMENTS

2009/0262431 A1 10/2009 Asakura et al.
2020/0190731 A1 6/2020 Min et al.

FOREIGN PATENT DOCUMENTS

CN 111051605 A 4/2020
JP 2003-127258 A 5/2003
JP 2009-282511 A 12/2009
(Continued)

OTHER PUBLICATIONS

Nakamura et al. JP 2004314509 (Year: 2004).*

*Primary Examiner* — Lawrence D Ferguson
(74) *Attorney, Agent, or Firm* — Foley & Lardner LLP

(57) ABSTRACT

An object of the present invention is to provide a skin material excellent in tactile sensation.
The present invention provides a skin material having at least a topcoat layer, wherein an arithmetic mean roughness Ra of a surface of the topcoat layer is 12 μm or less, an average spacing S of convex portions of the surface of the topcoat layer is 250 to 450 μm, and the topcoat layer contains resin beads with an average particle size of 5 to 20 μm.

10 Claims, 1 Drawing Sheet

(56) References Cited

FOREIGN PATENT DOCUMENTS

| | | | |
|---|---|---|---|
| JP | 2010-082960 | A | 4/2010 |
| JP | 2017-078242 | A | 4/2017 |
| KR | 10-2020-0131774 | A | 11/2020 |

* cited by examiner

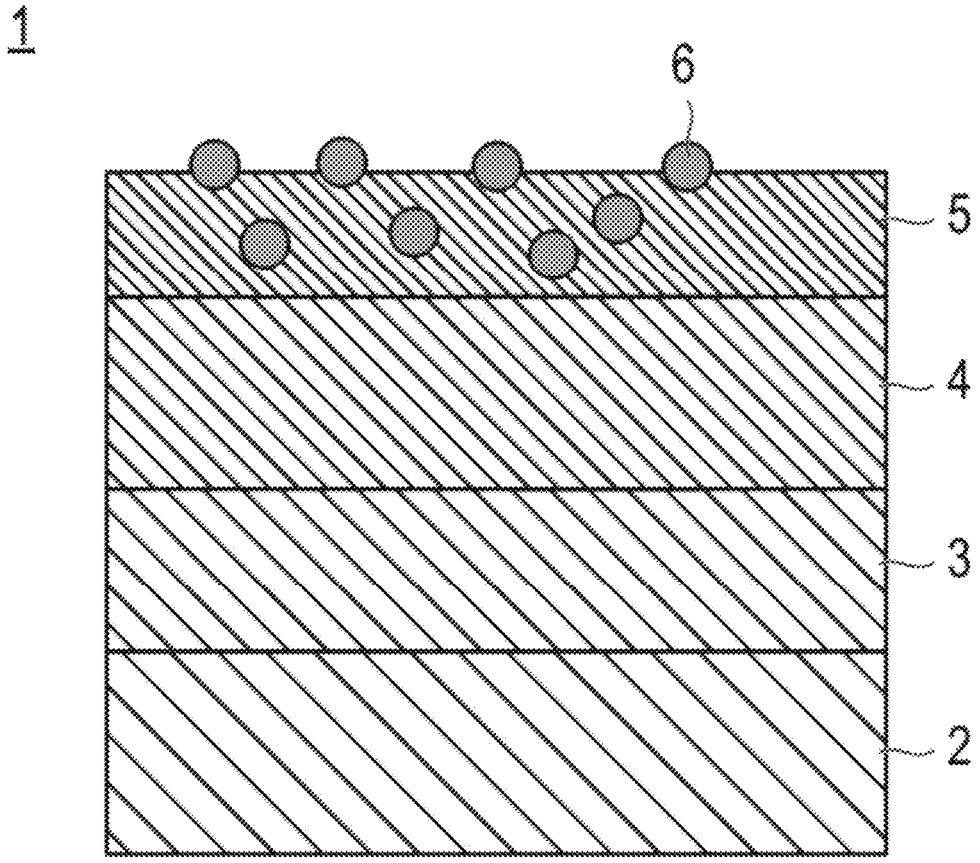
1
6
5
4
3
2

SKIN MATERIAL

TECHNICAL FIELD

The present invention relates to a skin material.

BACKGROUND ART

In general, genuine or synthetic leather is used for skin materials used for steering, seats, doors, instrument panels, assist grips, grips, and the like of automobiles. As a skin material of synthetic leather, for example, a skin material having a topcoat layer provided on a surface thereof is used. The skin material has been conventionally required to have a good tactile sensation, and for example, JP 2003-127258 A discloses a technique of obtaining a skin material having mat-like appearance and tactile sensation using a release sheet having fine unevenness.

SUMMARY OF INVENTION

However, as a result of studies by the present inventors, it has been found that it is difficult to obtain a comfortable moist tactile sensation like genuine leather even in the case of the skin material using the technique described in JP 2003-127258 A. As described above, there is still room for improvement in the technique described in JP 2003-127258 A.

The present invention has been made in view of the above circumstances, and an object of the present invention is to provide a skin material excellent in tactile sensation.

The present inventors have carried out a diligent study to solve the problem described above. As a result, the present inventors have found that the problem described above can be solved by controlling the surface roughness and average spacing of convex portions of the surface of the topcoat layer to predetermined values and allowing the topcoat layer to contain resin beads having a predetermined average particle size, and have completed the present invention.

Hence, the present invention is a skin material including at least a topcoat layer, in which an arithmetic mean roughness Ra of a surface of the topcoat layer is 12 μm or less, and an average spacing S of convex portions of the surface of the topcoat layer is 250 to 450 μm, and the topcoat layer contains resin beads having an average particle size of 5 to 20 μm.

BRIEF DESCRIPTION OF DRAWINGS

FIG. 1 is a schematic cross-sectional view illustrating a skin material according to one embodiment of the present invention.

DESCRIPTION OF EMBODIMENTS

One aspect of the present invention is a skin material including at least a topcoat layer, in which an arithmetic mean roughness Ra of a surface of the topcoat layer is 12 μm or less, and an average spacing S of convex portions of the surface of the topcoat layer is 250 to 450 μm, and the topcoat layer contains resin beads having an average particle size of 5 to 20 μm. According to the present invention, a skin material excellent in tactile sensation can be obtained.

In recent years, the texture of the interior of an automobile has been more emphasized. Thus, in order to make the appearance of resin parts used for interior close to that of genuine leather, a low-gloss resin material, a low-gloss paint, or the like has been developed. Meanwhile, as an element constituting the texture, tactile sensation is also important, in addition to visual texture. Examples of the tactual factor representing the tactile sensation include a rough-smooth feeling, a dry-wet feeling, a hard-soft feeling, and a warm-cold feeling defined by KES. Among these factors, the rough-smooth feeling is a tactual factor representing unevenness of the surface, and is a tactile sensation, such as "smoothness" or "roughness" felt when a person's hand touches the surface. The dry-wet feeling is a tactual factor representing the moist and smoothness feeling of the surface, and is a tactile sensation, such as "wetness" or "dryness" felt when a person's hand touches the surface. Increasing both the rough-smooth feeling due to the surface roughness and the dry-wet feeling due to the frictional force makes it possible to obtain a comfortable "moist" tactile sensation.

However, when the surface roughness is decreased, the frictional force is reduced, and thus both the surface roughness and the frictional force are in a contradictory relationship. Consequently, it has been difficult to achieve both the "smooth" tactile sensation and the "moist" tactile sensation in the skin material used for the interior of an automobile or the like.

In the skin material of the present invention, the arithmetic mean roughness (hereinafter, also referred to as surface roughness) Ra of the surface of the topcoat layer is 12 μm or less, and the average spacing S of convex portions of the surface of the topcoat layer is 250 to 450 μm, and thus the spacing of convex portions is close to the spacing of fingerprints, and the best rough-smooth feeling is given. Further, resin beads having an average particle size of 5 to 20 μm are added to the topcoat layer, and thus the frictional resistance can be increased without affecting the arithmetic mean roughness Ra of the surface. As a result, it is considered that both the rough-smooth feeling and the dry-wet feeling can be achieved, and thus a comfortable moist tactile sensation that cannot be expressed by the conventional skin material can be obtained.

Hereinafter, the embodiment of the present invention will be appropriately described with reference to the drawings. The present invention is not limited only to the following embodiment. In the description of the drawings, the same elements are denoted by the same reference numerals, and redundant description will be omitted. Further, the dimensional ratios of the drawings are exaggerated for convenience of description and may differ from the actual ratios. Further, in the present specification, the expression "X to Y" showing a range includes X and Y, and represents "X or more and Y or less". Furthermore, unless otherwise indicated, operations and measurements of physical properties and the like are carried out under conditions of room temperature (of 20 to 25° C.) and relative humidity of 40 to 50% RH.

[Skin Material]

The skin material of the present invention is not particularly limited as long as the skin material has a topcoat layer which has a surface having a predetermined surface roughness and a predetermined average spacing of convex portions of the surface, and contains resin beads having a predetermined average particle size. The topcoat layer is preferably formed directly or with another layer interposed therebetween on a surface of a base material. Preferably, the topcoat layer is formed on the base material with a surface layer interposed therebetween. In a preferred embodiment of the present invention, an adhesive layer is provided between the surface layer and the base material. Further, in the skin material according to one embodiment of the present invention, another layer such as a urethane resin layer may be provided on a surface opposite to the topcoat layer of the base material.

FIG. 1 is a schematic cross-sectional view schematically illustrating a skin material according to one embodiment of the present invention. A skin material 1 of the present embodiment has an adhesive layer 3, a surface layer 4, and a topcoat layer 5 in this order on one surface of a base material 2. The topcoat layer 5 contains resin beads 6. Hereinafter, main components of the skin material described above will be described. However, the form of the skin material of the present invention is not limited to the form shown in FIG. 1.

(Topcoat Layer)

The topcoat layer is formed on the outermost side of the skin material. In the present specification, the "outermost side" means a side that a user directly touches.

In the skin material of the present embodiment, the arithmetic mean roughness Ra of the surface of the topcoat layer is 12 μm or less. When the arithmetic mean roughness Ra is more than 12 μm, a smooth tactile sensation cannot be obtained. The Ra is preferably 11 μm or less from the viewpoint of obtaining a tactile sensation with less unevenness. Meanwhile, the Ra is preferably 5 μm or more, and more preferably 7 μm or more, from the viewpoint of more easily obtaining a reduction in unevenness according to the reduction in the Ra. Further, the Ra is still more preferably 9 μm or more from the viewpoint of suppressing gloss and imparting a luxurious appearance. In the present specification, the Ra can be obtained by the method described in the following Examples.

In the skin material of the present embodiment, the average spacing S of convex portions of the surface of the topcoat layer is 250 to 450 μm. When the average spacing S is less than 250 μm or more than 450 μm, a suitable rough-smooth feeling cannot be obtained, and thus a comfortable tactile sensation is not obtained. Preferably, the S is 280 to 420 μm. In a case where the S is in the above range, the effect of the present invention can be more remarkably obtained. In the present specification, the S is an average value of spacings between adjacent convex portions (local peaks), and can be obtained by the method described in the following Examples.

The method for controlling the arithmetic mean roughness Ra of the surface of the topcoat layer and the average spacing S of convex portions of the surface of the topcoat layer is not particularly limited, but as described later, the arithmetic mean roughness Ra and the average spacing S of convex portions of the surface of the topcoat layer can be controlled by using a releasable base material such as release paper having desired unevenness.

The topcoat layer contains resin beads having an average particle size of 5 to 20 μm. The resin beads are not particularly limited, and examples thereof include acrylic beads, urethane beads, nylon beads, styrene beads, and the like. Among these beads, acrylic beads or urethane beads are preferably used, and urethane beads are more preferably used, from the viewpoint of imparting excellent tactile sensation. When the topcoat layer contains a urethane resin as a binder resin, use of urethane beads makes it possible to improve the dispersibility of the resin beads and improve the coatability, which is preferable. As the resin beads, crosslinked resin beads may be used. Examples of the crosslinked resin beads include crosslinked acrylic beads, crosslinked urethane beads, and the like.

Here, when the average particle size of the resin beads is less than 5 μm, the frictional resistance of the surface cannot be sufficiently increased, and thus a moist tactile sensation cannot be obtained. Meanwhile, when the average particle size is more than 20 μm, the surface roughness is affected, and the tactile sensation becomes rough. When the average particle size of the resin beads is 7 μm or more, the effect of increasing the frictional force is higher, and thus a more excellent dry-wet feeling is given, which is preferable. Further, when the average particle size of the resin beads is 15 μm or less, a more excellent rough-smooth feeling is given, and falling off of the resin beads due to abrasion is less likely to occur, which is preferable. In the present specification, the average particle size is a value measured by surface SEM observation.

A content of the resin beads in the topcoat layer is not particularly limited, but is preferably 5 to 10 mass % (in terms of solid content) relative to the total amount of the topcoat layer. When the content of the resin beads is 5 mass % or more, the effect of increasing the frictional force of the surface is excellent. Meanwhile, when the content is 10 mass& or less, the viscosity of a resin solution as a coating liquid is not excessively increased during forming the topcoat layer. Thus, the resin solution can be easily applied, which is preferable. Further, it is less likely to affect the surface roughness, which is preferable.

Preferably, the topcoat layer contains a binder resin such as a polyurethane resin. The polyurethane resin is not particularly limited, but examples thereof include a polycarbonate polyurethane resin, a polyester polyurethane resin, a polyether polyurethane resin, and the like. These resins can be used singly or in combination of two or more thereof. Among the resins, a polycarbonate polyurethane resin is preferable because it is excellent in wear resistance and weather resistance. Further, a form of the polyurethane resin can be used regardless of whether it is a solvent-free type, a hot-melt type, a solvent type, or an aqueous type, and furthermore, regardless of whether it is a one-pack type or a two-pack curing type. The form may be appropriately selected depending on the intended use and application.

The polycarbonate polyurethane resin is a polyurethane resin having a polycarbonate skeleton in the main chain, and is synthesized by a urethane reaction between a polycarbonate diol and a diisocyanate. The polycarbonate polyurethane resin may be either a non-crosslinked polycarbonate polyurethane resin or a crosslinked polycarbonate polyurethane resin. The polycarbonate diol is obtained by, for example, reacting at least one carbonate compound selected from the group consisting of an alkylene carbonate, a diaryl carbonate, and a dialkyl carbonate with a diol and/or a polyether polyol. Examples of the alkylene carbonate among the carbonate compounds described above include, but are not limited to, ethylene carbonate, 1,2-propylene carbonate, 1,2-butylene carbonate, and the like. Examples of the diaryl carbonate include, but are not limited to, diphenyl carbonate, phenyl-naphthyl carbonate, dinaphthyl carbonate, 4-methyldiphenyl carbonate, 4-ethyldiphenyl carbonate, 4-propyldiphenyl carbonate, 4,4'-dimethyl-diphenyl carbonate, 4,4'-diethyl-diphenyl carbonate, 4,4'-dipropyl-diphenyl carbonate, and the like. Examples of the dialkyl carbonate include, but are not limited to, dimethyl carbonate, diethyl carbonate, di-n-propyl carbonate, diisopropyl carbonate, di-n-butyl carbonate, diisobutyl carbonate, di-t-butyl carbonate, di-n-amyl carbonate, diisoamyl carbonate, and the like. Examples of the diol to be reacted with the carbonate compound include, but are not limited to, ethylene glycol, 1,2-propanediol, 1,3-propanediol, 1,3-butanediol, 1,4-butanediol, 2-methyl-1,3-propanediol, neopentyl glycol, 2-methyl-pentanediol, 3-methyl-pentanediol, 2,2,4-trimethyl-1,6-hexanediol, 2,3,5-trimethylpentanediol, a mixture thereof, and the like. Examples of the polyether polyol include, but are not limited to, for example, polytetramethylene glycol obtained by ring-opening polymerization of tetrahydrofuran, alkylene oxide adduct of diols, a mixture thereof, and the like. Examples of the diols include, but are not limited to, ethylene glycol, 1,2-propanediol, 1,3-propanediol, 1,3-butanediol, 1,4-butanediol, isomeric pentanediols, isomeric hexanediols or octanediols (e.g. 2-ethyl-1,3-hexanediol, 1,2-bis(hydroxymethyl)-cyclohexanone, 1,3-bis(hydroxymethyl)-cyclohexanone, 1,4-bis(hydroxymethyl)-cyclohexanone, trimethylolpropane), glycerin, and the like. Examples of the alkylene oxide include, but are not limited to, ethylene oxide, propylene oxide, 1,2-butylene oxide, 1,3-butylene oxide, 2,3-butylene oxide, tetrahydrofuran, styrene oxide, epichlorohydrin, and the like. The alkylene oxide may be used singly or in combination of two or more kinds thereof. The diols and the polyether polyols may also be used singly or in combination of two or more thereof. Examples of the diisocyanate include, but are not limited to, aliphatic diisocyanates such as tetramethylene diisocyanate and hexamethylene diisocyanate (HDI), alicyclic diisocyanates such as 1,4-cyclohexane diisocyanate and isophorone diisocyanate (IPDI), and aromatic diisocyanates such as tolylene diisocyanate (TDI), xylylene diisocyanate and 4,4'-diphenylmethane diisocyanate (MDI), and the like. The above reaction may be performed in the presence of a chain extender such as 1,4-butanediol, 1,6-hexanediol, or ethylenediamine. A molecular weight (weight-average molecular weight) of the polycarbonate polyurethane resin is not particularly limited, but is preferably 15,000 to 150,000. The polycarbonate polyurethane resin may be used singly or in the form of a mixture of two or more kinds.

The polyester polyurethane resin is a polyurethane resin having a polyester skeleton in the main chain, and is synthesized by a reaction between a polyester polyol and a diisocyanate. The above reaction may be performed in the presence of a chain extender. Here, examples of the polyester polyol include, but are not limited to, those obtained by polycondensation of a dicarboxylic acid such as adipic acid, azelaic acid, sebacic acid, succinic acid, glutaric acid, maleic acid, fumaric acid, phthalic acid, isophthalic acid, or terephthalic acid with a glycol such as ethylene glycol, propylene glycol, 1,4-butanediol, 1,3-butanediol, 1,6-hexanediol, 1,8-octamethylenediol, neopentyl glycol, bishydroxymethylcyclohexane, bishydroxyethylbenzene, or alkyldialkanolamine, and the like. Examples of the diisocyanate include, but are not limited to, 1,5-naphthylene diisocyanate, 4,4'-diphenylmethane diisocyanate, 4,4'-diphenyldimethylmethane diisocyanate, 4,4'-dibenzyl isocyanate, dialkyldiphenylmethane diisocyanate, tetraalkyldiphenylmethane diisocyanate, 1,3-phenylene diisocyanate, 1,4-phenylene diisocyanate, tolylene diisocyanate, butane-1,4-diisocyanate, hexamethylene diisocyanate, isopropylene diisocyanate, methylene diisocyanate, 2,2,4-trimethylhexamethylene diisocyanate, cyclohexane-1,4-diisocyanate, xylylene diisocyanate, isophorone diisocyanate, lysine diisocyanate, dicyclohexylmethane-4,4'-diisocyanate, 1,3-bis(isocyanate methyl)cyclohexane, methylcyclohexane diisocyanate, norbornane diisocyanate, m-tetramethylxylylene diisocyanate, dimer diisocyanate obtained by converting a carboxyl group of dimer acid to an isocyanate group, and the like. A molecular weight (weight-average molecular weight) of the polyester polyurethane resin is not particularly limited, but is preferably 15,000 to 150,000. The polyester polyurethane resin may be used singly or in the form of a mixture of two or more kinds.

The polyether polyurethane resin is a polyurethane resin having a polyether skeleton in the main chain, and is synthesized by a reaction between a polyether polyol and a diisocyanate. The above reaction may be performed in the presence of a chain extender. Here, the polyether polyol is not particularly limited, but the same polyether polyol as described in the section of the polycarbonate polyurethane resin can be used. Examples of the diisocyanate include, but are not limited to, aliphatic diisocyanates such as hexamethylene diisocyanate, tolidine diisocyanate, isophorone diisocyanate, 1,3-xylylene diisocyanate, 1,4-xylylene diisocyanate, cyclohexane diisocyanate, toluidine diisocyanate, 2,4-tolylene diisocyanate, 2,6-tolylene diisocyanate, 4,4'-diphenylmethane diisocyanate, p-phenylene diisocyanate, m-phenylene diisocyanate, and 1,5-naphthalene diisocyanate, aromatic diisocyanates, and the like. The diisocyanate may be used singly or in combination of two or more thereof. A molecular weight (weight-average molecular weight) of the polyether polyurethane resin is not particularly limited, but is preferably 15,000 to 150,000. The polyether polyurethane resin may be used singly or in the form of a mixture of two or more kinds.

The presence of each resin in the topcoat layer can be confirmed, for example, by performing NMR measurement (1H-NMR measurement, 13C-NMR measurement, etc.), infrared spectrum analysis, GC-MS analysis, or the like.

The topcoat layer may contain an additional component, in addition to the above components. Here, the additional component is not particularly limited, and known materials usually used for a topcoat layer of a leather material can be similarly used. Specific examples of the additional component include a pigment, a crosslinking agent (curing agent) (e.g. an isocyanate-based crosslinking agent or a carbodiimide-based crosslinking agent), an auxiliary agent, a tactile agent (e.g. a silicone-based tactile agent), a leveling agent, a thickener, an ultraviolet absorber, and the like. Each of the additional components may be used singly or in the form of a mixture of two or more kinds. Alternatively, two or more of the above additional components may be used in combination. The crosslinking agent promotes crosslinking between resins during formation of the topcoat layer, thereby enabling the strength of the topcoat layer to be improved.

A dynamic friction coefficient μd of the topcoat layer is not particularly limited, but is, for example, 0.35 or more, preferably 0.40 to 0.60, more preferably 0.48 to 0.56, still more preferably 0.52 to 0.56, and particularly preferably 0.54 to 0.56. When the dynamic friction coefficient is within the above range, a more excellent dry-wet feeling can be obtained. The dynamic friction coefficient μd of the topcoat layer can be obtained by the method described in the following Examples.

A thickness (thickness in a dried state) of the topcoat layer is not particularly limited, and is, for example, 1 to 200 μm, preferably 2 to 100 μm. When the thickness is 1 μm or more, the wear resistance of the resulting skin material can be improved. When the thickness is 200 μm or less, the resulting skin material can have a good texture.

(Base Material)

The base material is not particularly limited, and base materials of resin films, such as polyester resins such as polyethylene terephthalate and polyethylene naphthalate, polyamide resins such as various nylons, and polyolefin resins such as polypropylene, fibrous base materials, and the like can be used, but the base material is preferably a fibrous base material. The fibrous base material is not particularly limited, and examples thereof include cloth fabrics such as knitted fabrics, woven fabrics, and nonwoven fabrics, and natural leather (including split leather). As the cloth fabric, a cloth fabric, which is coated or impregnated with a conventionally known solvent-based or solvent-free (including aqueous) polymer compound (e.g. a polyurethane resin or a copolymer thereof, and a polyvinyl chloride resin), and dry-solidified or wet-solidified, may be used. A known pretreatment agent (e.g. a penetrant, a water repellent, a flame retardant, an ultraviolet absorber, etc.) may be applied to the cloth fabric. The fibrous base material may be colored with a dye or a pigment. Further, the surface of the fibrous base material may have a raised portion formed by the conventionally known raising treatment.

A type of fiber constituting the fibrous base material is also not particularly limited, and examples thereof include conventionally known fibers, such as natural fibers, regenerated fibers, semisynthetic fibers, and synthetic fibers, and two or more kinds thereof may be combined. Among the fibers, from the viewpoint of strength and processability, synthetic fibers are preferable, and polyester fibers are more preferable.

A thickness of the base material is not particularly limited, and conventionally known knowledge can be appropriately adopted, but the thickness can be, for example, 0.1 to 10 mm. A density of the base material is also not particularly limited, but may be, for example, 0.05 to 5 g/cm$^3$ when a fibrous base material is used.

(Surface Layer)

In the leather material of the present embodiment, a surface layer may be disposed on a base material. The surface layer may be provided directly on the base material, or may be provided with another layer such as an adhesive layer interposed therebetween. Providing the surface layer makes it possible to stably form the topcoat layer on the surface layer. As described later, providing unevenness on the surface of the surface layer makes it possible to impart desired surface roughness or desired unevenness to the surface of the topcoat layer.

Here, the surface layer is not particularly limited, and a material similar to that usually used in the field of leather materials can be applied, but the surface layer preferably contains a resin such as a polyurethane resin. The polyurethane resin used for the surface layer is not particularly limited, and conventionally known polyurethane resins can be used. Examples of the polyurethane resin include a polyether polyurethane resin, a polyester polyurethane resin, a polycarbonate polyurethane resin, and the like. These resins can be used singly or in combination of two or more thereof. Among the resins, a polycarbonate polyurethane resin is preferable from the viewpoint of wear resistance, and a polyether polyurethane resin is preferable from the viewpoint of texture. As polyurethane resins such as a polyether polyurethane resin, a polyester polyurethane resin, and a polycarbonate polyurethane resin, the same polyurethane resins as those described in the topcoat layer can be used. Further, a form of the polyurethane resin can be used regardless of whether it is a hot-melt type, a solvent type, an aqueous type, or the like, and furthermore, regardless of whether it is a one-pack type or a two-pack curing type. The form may be appropriately selected depending on the intended use and application.

The surface layer may contain known additives, for example, a thermal stabilizer, a thermoplastic resin, a thermosetting resin, a pigment, a flame retardant, a conductivity imparting agent, an antistatic agent, a moisture permeability improver, a water repellent, an oil repellent, a water absorbent, a moisture absorbent, a deodorant, an antifoamer, a pigment dispersant, a hydrolysis inhibitor, a crosslinking agent, a thickener, and the like, as necessary.

A thickness of the surface layer (thickness in a dried state) is not particularly limited, but is, for example, 5 to 100 μm, more preferably 20 to 50 μm. When the thickness is 5 μm or more, the wear resistance is excellent. Further, when the thickness is 100 μm or less, the texture is excellent, which is preferable.

(Adhesive Layer)

The base material and the surface layer may be directly laminated, or may be bonded with an adhesive layer interposed therebetween. As a result of interposing the adhesive layer, excessive penetration of the resin constituting the surface layer into the base material is suppressed, which is preferable. Further, formation of ununiform holes in the surface layer is suppressed, and natural leather-like tactile sensation and texture can be provided. A material constituting the adhesive layer is not particularly limited, but a resin similar to the resin used for the surface layer can be used. For example, a polyurethane resin can be preferably used. A thickness (thickness in a dried state) of the adhesive layer is also not particularly limited, and is, for example, 1 to 500 μm.

(Manufacturing Method)

The method for manufacturing the skin material of the present embodiment is not particularly limited. As an example, a method including the following steps may be used:

(1) applying a resin solution for surface layer onto a releasable base material to form a surface layer;
(2) bonding the surface layer and the base material to each other;
(3) peeling off the releasable base material; and
(4) applying a resin solution for topcoat layer to a surface, where the releasable base material on the surface layer has been peeled off, to form a topcoat layer.

The resin solution for surface layer can be obtained by mixing the resin constituting the surface layer with an additive, a solvent, and the like as necessary. As the method for applying the resin solution for surface layer onto the releasable base material, various conventionally known methods can be adopted, and the method is not particularly limited. Examples of the method include a method using an apparatus such as a reverse roll coater, a spray coater, a roll coater, a knife coater, or a comma coater. Among them, application by a reverse roll coater, a roll coater, a spray coater, or a comma coater is preferable in that a uniform thin film layer can be formed.

The releasable base material is not particularly limited, and may be a base material having releasability to a polyurethane resin or the like, or a base material subjected to a release treatment. Examples of the releasable base material include a release paper, a cloth subjected to a release treatment, a cloth subjected to a water repellent treatment, an olefin sheet or film made of a polyethylene resin, a polypropylene resin, or the like, a fluorine resin sheet or film, a plastic film with a release paper, and the like.

The releasable base material has unevenness. The height of the unevenness (a value defined similarly to the above Ra) and the width of the unevenness (a distance between apexes of adjacent convex portions, a value defined similarly to the S above) may be appropriately set so as to impart a desired surface roughness Ra and a desired average spacing S of convex portions to the topcoat layer.

After the resin solution for surface layer is applied to the releasable base material, a heat treatment is performed as necessary. The heat treatment is performed to evaporate the solvent in the resin solution for surface layer and dry the resin. Further, in the case of using a crosslinking agent that causes a crosslinking reaction by heat treatment or in the case of using a two-pack curing type resin, the heat treatment is performed in order to accelerate the reaction and form a film having sufficient strength.

The heat treatment temperature is not particularly limited, but is, for example, 50 to 150° C., preferably 60 to 140° C. When the heat treatment temperature is 50° C. or higher, the heat treatment does not take too long time, whereby the process load does not become too large. Further, it is possible to prevent the resin from being insufficiently crosslinked, and thus it is possible to prevent the wear resistance from being poor. When the heat treatment temperature is 150° C. or lower, the skin material is excellent in texture. The heat treatment time is not particularly limited, and is, for example, 1 to 20 minutes, preferably 1 to 10 minutes. When the heat treatment time is 1 minute or longer, it is possible to prevent crosslinking of the resin from being insufficient. Accordingly, it is possible to prevent wear resistance from being poor. When the heat treatment time is within 20 minutes, the process load does not become too large.

Next, the surface layer is bonded to the base material (e.g. a fibrous base material). In the bonding, as described above, the base material and the surface layer may be directly laminated, or may be bonded with an adhesive layer interposed therebetween.

Means for forming the adhesive layer is also not particularly limited, but a method can be used in which the resin constituting the adhesive layer is mixed with an additive, a solvent, and the like as necessary to prepare a resin solution for adhesive layer, and the resin solution is applied to the surface layer or the base material. As the method for applying the resin solution for adhesive layer, various known methods can be adopted, and the method is not particularly limited. Examples of the method include a method using an apparatus such as a reverse roll coater, a spray coater, a roll coater, a gravure coater, a kiss roll coater, a knife coater, or a comma coater.

Next, the releasable base material is peeled off from the surface layer, and then the resin solution for topcoat layer is applied onto the surface layer, and thus a topcoat layer having unevenness on the surface can be formed. The resin solution for topcoat layer can be obtained by mixing, for example, resin beads, a binder resin constituting the topcoat layer, an additive, additional components, a solvent, and the like.

The method for applying the resin solution for topcoat layer is not particularly limited, and examples thereof include a method using an apparatus such as a reverse roll coater, a spray coater, a roll coater, a gravure coater, a kiss roll coater, a knife coater, or a comma coater. The coating thickness may be appropriately set according to a desired thickness of the topcoat layer.

Next, a heat treatment is performed as necessary. The heat treatment is performed in order to evaporate the solvent in the resin solution for topcoat layer to dry the resin. In addition, in the case of using a crosslinking agent that causes a crosslinking reaction by heat treatment or in the case of using a two-pack curing type resin, the heat treatment is performed in order to accelerate the reaction and form a film having sufficient strength.

The heat treatment temperature is preferably 50 to 150° C., and more preferably 60 to 140° C. When the heat treatment temperature is 50° C. or higher, the heat treatment can be performed in a short time, and the process load is small. When the heat treatment temperature is 150° C. or lower, the skin material is excellent in texture. The heat treatment time is preferably 1 to 20 minutes, and more preferably 1 to 10 minutes. When the heat treatment time is 1 minute or longer, it is possible to prevent crosslinking of the resin from being insufficient. Accordingly, it is possible to prevent wear resistance from being poor. When the heat treatment time is within 20 minutes, the process load does not become too large.

(Usage)

The skin material of the present invention has a moist tactile sensation like genuine leather. Therefore, the skin material of the present invention can be used for various products including interior materials for automobiles, interior products such as sofas, shoes, and bags. In particular, the skin material of the present invention can be suitably used for steering, seats, doors, instrument panels, assist grips, grips, and the like for automobiles, for example.

The present invention includes the following aspects and modes:

1. A skin material including at least a topcoat layer, in which an arithmetic mean roughness Ra of a surface of the topcoat layer is 12 μm or less, and an average spacing S of convex portions of the surface of the topcoat layer is 250 to 450 μm, and the topcoat layer contains resin beads having an average particle size of 5 to 20 μm;

2. The skin material according to 1. above, in which the topcoat layer contains 5 to 10 mass % of the resin beads in terms of solid content relative to a total amount of the topcoat layer;

3. The skin material according to 1, or 2. above, in which the average particle size of the resin beads is 7 to 15 μm;

4. The skin material according to any one of 1. to 3. above, in which the Ra is 9 to 11 μm;

5. The skin material according to any one of 1. to 4. above, in which the topcoat layer contains a polycarbonate polyurethane resin;

6. The skin material according to any one of 1. to 5. above, in which the resin beads are urethane beads;

7. The skin material according to any one of 1. to 6. above, in which a dynamic friction coefficient of the topcoat layer is 0.40 to 0.60; and 8. The skin material according to 7. above, in which the dynamic friction coefficient of the topcoat layer is 0.48 to 0.56.

EXAMPLES

The effects of the present invention are described with reference to the following Examples and Comparative Examples. However, the technical scope of the present invention is not limited to the following Examples. In the following Examples, unless otherwise specified, operations were performed at room temperature (25° C.). Further, unless otherwise specified, "%" and "parts" refer to "mass %" and "parts by mass", respectively.

Example 1

First, a resin solution for surface layer was prepared. Specifically, 40 parts by mass of dimethylformamide was added to 100 parts by mass of polycarbonate polyurethane resin (CRISVON S-707, manufactured by DIC Corporation)

so as to adjust the viscosity to about 2000 mPa·s, and thus a resin solution for surface layer was prepared.

Next, a resin solution for adhesive layer was prepared. Specifically, 10 parts by mass of a curing agent (NE-crosslinking agent, manufactured by Dainichiseika Color & Chemicals Mfg. Co., Ltd.), 1 part by mass of a catalyst (ACCEL F, manufactured by DIC Corporation), and 50 parts by mass of dimethylformamide were added to 100 parts by mass of polycarbonate polyurethane resin (CRISVON TA-205, manufactured by DIC Corporation) so as to adjust the viscosity to about 4500 mPa·s, and thus a resin solution for adhesive layer was prepared.

Next, the resin solution for surface layer prepared as described above was applied onto a release paper having unevenness formed thereon, the height of unevenness being 10 μm, the width of unevenness (distance between apexes of adjacent convex portions) being 300 μm, using a comma coater. Then, the resultant was dried at 130° C. for 2 minutes to form a surface layer having a thickness of 30 μm. In the present specification, the height of the unevenness and the width of the unevenness of the releasable base material are values respectively determined by a similar definition to the arithmetic mean roughness Ra of the surface of the topcoat layer and the average spacing S of convex portions of the surface of the topcoat layer, and are measured in accordance with JIS B0601: 1994.

The resin solution for adhesive layer prepared above was coated onto the surface layer obtained above using a comma coater, and the resulting layer was then dried at 100° C. for 3 minutes to form an adhesive layer having a thickness of 190 μm. A polyester tricot fabric (density 43 c/inch 46 w/inch) having a thickness of 1.46 mm as a base material was bonded to the coated surface, and further dried to form a laminated body.

Next, a resin solution for topcoat layer was prepared according to the following formulation.

Polycarbonate polyurethane resin (trade name: PERMUTEX EX-RU-13-085F, manufactured by Stahl Japan Limited, solid content: 30 mass %): 220 parts by mass Resin beads (urethane beads, average particle size: 7 μm, DAIMIC BEAZ UCN-5070D, manufactured by Dainichiseika Color & Chemicals Mfg. Co., Ltd., solid content: 100 mass %): 7.5 parts by mass Crosslinking agent (PERMUTEX XR-5508, manufactured by Stahl Japan Limited, solid content: 40 mass %): 4 parts by mass Water: appropriate amount.

In the laminated body obtained as described above, the release paper was removed, the resin solution for topcoat layer was coated onto the surface layer using a reverse roll coater, and the resulting layer was then dried at 130° C. for 2 minutes to form a topcoat layer having a thickness of 8 μm. Thus, a skin material of Example 1 was prepared.

Examples 2 to 9, Comparative Examples 1 to 5

Skin materials of Examples 2 to 9 and Comparative Example 1 to 5 were prepared in a similar manner to Example 1 except that the release paper was changed to each one having the height of unevenness and the width of unevenness shown in Table 1 below, and the average particle size and the addition amount (content) of the resin beads were changed as shown in Table 1 below in Example 1.

[Arithmetic Mean Roughness Ra of Surface of Topcoat Layer and Average Spacing S of Convex Portions of Surface of Topcoat Layer]

With respect to the skin material prepared in each of the Examples and Comparative Examples, the arithmetic mean roughness Ra of the surface of the topcoat layer and the average spacing S of convex portions of the surface of the topcoat layer were measured in accordance with JIS B0601: 1994. The results are shown in Table 1 below.

[Evaluation of Tactile Sensation]

The skin material prepared in each of the Examples and Comparative Examples was stuck to an A4 size veneer board with a tape, and each of the resulting samples was placed in a covered box made of corrugated board such that the skin material was not visible. 10 panelists were asked to touch the outermost surface of each of the skin materials at a place with a temperature of 23±2° C. and a humidity of 50±5% and grade the rough-smooth feeling and dry-wet feeling.

Here, the panelists graded the rough-smooth feeling in six levels of from 0 score (rough) to 5 score (smooth) by 1 score, and graded the dry-wet feeling in six levels of 0 score (dry) to 5 score (moist) by 1 score. The average score was used for the evaluation results. The results are shown in Table 1 below. In Table 1 below, ○, →, and x follow the following criteria. In the case of Δ or ○, the sample can be used without any problem.

(Evaluation Criteria for Rough-Smooth Feeling)

○: score of 4 or more;

Δ: score of more than 3 and less than 4; and x: score of 3 or less.

(Evaluation Criteria for Dry-Wet Feeling)

○: score of 4 or more;

Δ: score of more than 3 and less than 4; and x: score of 3 or less.

[Evaluation of Appearance]

10 panelists were asked to see the skin material prepared in each of Examples and Comparative Examples, and asked whether the appearance of the outermost surface of the skin material was like genuine leather or resin. The evaluation results according to the following criteria are shown in Table 1. In the following criteria, a case of ○ or Δ was graded as acceptable:

○: 8 or more panelists answered that the appearance was like genuine leather;

Δ: 5 to 7 panelists answered that the appearance was like genuine leather; and x: 4 or less panelists answered that the appearance was like genuine leather.

[Measurement of Dynamic Friction Coefficient]

The dynamic friction coefficient μd of the surface of the topcoat layer was measured for the skin material prepared in each of Examples and Comparative Examples. As an apparatus, a robot arm type friction characteristic measuring machine, manufactured by Shinto Scientific Co., Ltd., was used. A spherical indenter (diameter: 10 mm) was used as an indenter, and the load was 200 g and the speed was 50 mm/sec. The results are shown in Table 1 below. In the following criteria, a case of ⊙, ○, or Δ was graded as acceptable:

⊙: μd is 0.48 or more;

○: μd is 0.40 or more and less than 0.48;

Δ: μd is 0.35 or more and less than 0.40; and x: μd is less than 0.35.

TABLE 1

| | Release paper | | Topcoat layer | | | | Evaluation | | | | | | |
|---|---|---|---|---|---|---|---|---|---|---|---|---|---|
| | Height of unevenness (μm) | Width of unevenness (μm) | Surface roughness Ra (μm) | Average spacing S of convex portions (μm) | Resin beads: Average particle size (μm) | Resin beads: Addition amount (mass %) | Rough-smooth feeling | | Dry-wet feeling | | Appearance | Dynamic friction coefficient μd | |
| Example 1 | 10 | 300 | 10 | 300 | 7 | 10 | 5 score | ○ | 5 score | ○ | ○ | 0.56 | ⊙ |
| Example 2 | 9 | 280 | 9 | 280 | 5 | 10 | 5 score | ○ | 4.5 score | ○ | ○ | 0.54 | ⊙ |
| Example 3 | 11 | 420 | 11 | 420 | 20 | 10 | 4.5 score | ○ | 4.5 score | ○ | ○ | 0.54 | ⊙ |
| Example 4 | 12 | 280 | 12 | 280 | 7 | 5 | 4 score | ○ | 5 score | ○ | ○ | 0.56 | ⊙ |
| Example 5 | 12 | 420 | 12 | 420 | 7 | 10 | 4 score | ○ | 5 score | ○ | ○ | 0.56 | ⊙ |
| Example 6 | 8 | 280 | 8 | 280 | 5 | 10 | 5 score | ○ | 4 score | ○ | Δ | 0.52 | ⊙ |
| Example 7 | 8 | 280 | 8 | 280 | 20 | 2 | 5 score | ○ | 4 score | ○ | Δ | 0.52 | ⊙ |
| Example 8 | 12 | 420 | 12 | 420 | 20 | 20 | 4 score | ○ | 4 score | ○ | ○ | 0.52 | ⊙ |
| Example 9 | 7 | 350 | 7 | 350 | 7 | 10 | 5 score | ○ | 3.5 score | Δ | Δ | 0.48 | ⊙ |
| Comparative Example 1 | 13 | 350 | 13 | 350 | 7 | 10 | 3 score | X | 4 score | ○ | ○ | 0.52 | ⊙ |
| Comparative Example 2 | 10 | 550 | 10 | 550 | 7 | 10 | 3 score | X | 4 score | ○ | ○ | 0.52 | ⊙ |
| Comparative Example 3 | 10 | 200 | 10 | 200 | 7 | 10 | 3 score | X | 4 score | ○ | ○ | 0.52 | ⊙ |
| Comparative Example 4 | 10 | 350 | 10 | 350 | 1 | 10 | 5 score | ○ | 3 score | X | ○ | 0.38 | Δ |
| Comparative Example 5 | 10 | 350 | 10 | 350 | 30 | 10 | 3 score | X | 3.5 score | Δ | ○ | 0.38 | Δ |

From the results in Table 1 above, it was found that the skin materials of Example 1 to 9, in which the topcoat layer had a predetermined surface roughness and a predetermined average spacing of convex portions, and contained resin beads having a predetermined average particle size, had a high rough-smooth feeling and a high dry-wet feeling, and was excellent in tactile sensation. On the other hand, in Comparative Example 1 in which the surface roughness was larger than the predetermined value, Comparative Examples 2 and 3 in which a predetermined average spacing of convex portions was not provided, and Comparative Example 5 in which the average particle size of the resin beads was larger than the predetermined value, the rough-smooth feeling was low. In Comparative Example 4 in which the average particle size of the resin beads was smaller than the predetermined value, it was found that the dry-wet feeling was low.

This application is based on Japanese Patent Application No. 2021-199042 filed on Dec. 8, 2021, the disclosure of which is incorporated herein by reference in its entirety.

REFERENCE SIGNS LIST

1 Skin material;
2 Base material;
3 Adhesive layer;
4 Surface layer;
5 Topcoat layer;
6 Resin beads.

The invention claimed is:

1. A skin material comprising:

a surface layer; and a topcoat layer, wherein:

an arithmetic mean roughness Ra of a surface of the topcoat layer is 5 μm or more and less than 11 μm, and an average spacing S of convex portions of the surface of the topcoat layer is 250 to 450 μm, the topcoat layer contains resin beads having an average particle size of 7 to 20 μm, and the topcoat layer is formed by a process comprising applying a resin solution for the topcoat layer onto the surface layer and performing a heat treatment.

2. The skin material according to claim 1, wherein the topcoat layer contains 5 to 10 mass % of the resin beads in terms of solid content relative to a total amount of the topcoat layer.

3. The skin material according to claim 1, wherein the average particle size of the resin beads is 7 to 15 μm.

4. The skin material according to claim 1, wherein the Ra is 5 μm or more and 10 μm or less.

5. The skin material according to claim 1, wherein the topcoat layer contains a polycarbonate polyurethane resin.

6. The skin material according to claim 1, wherein the resin beads are urethane beads.

7. The skin material according to claim 1, wherein a dynamic friction coefficient of the topcoat layer is 0.40 to 0.60.

8. The skin material according to claim 7, wherein the dynamic friction coefficient of the topcoat layer is 0.48 to 0.56.

9. The skin material according to claim 1, wherein the Ra is 7 μm or more and less than 11 μm.

10. The skin material according to claim 1, wherein the Ra is 9 μm or more and less than 11 μm.

* * * * *